US005587051A

United States Patent [19]

Ostermayer et al.

[11] Patent Number: 5,587,051

[45] Date of Patent: Dec. 24, 1996

[54] SIMPLIFIED LASER APPARATUS AND METHOD FOR MEASURING STOCK THICKNESS ON PAPERMAKING MACHINES

[76] Inventors: Volker Ostermayer, 209 Gilderbrook Rd., Greenville, S.C. 29615; Thomas B. Fleischer, 108 Meadowood Ct., Pelzer, S.C. 29669

[21] Appl. No.: 337,770

[22] Filed: Nov. 14, 1994

Related U.S. Application Data

[63] Continuation-in-part of Ser. No. 282,924, Jul. 29, 1994.

[51] Int. Cl.[6] ..... D21F 7/00; G01N 21/90

[52] U.S. Cl. ..... 162/198; 162/258; 162/262; 162/252; 162/263; 162/DIG. 10; 356/256; 356/426; 250/339.11

[58] Field of Search ..... 162/258, 262, 162/252, 263, 198, DIG. 10, DIG. 11; 356/429, 381, 375; 250/561, 571, 560, 339.1, 339.11; 73/159

[56] References Cited

U.S. PATENT DOCUMENTS

| | | | |
|---|---|---|---|
| 2,909,660 | 11/1957 | Alexander | 162/259 |
| 3,040,807 | 11/1959 | Chope | 162/252 |
| 3,190,261 | 6/1965 | Ziffer | 118/665 |
| 3,235,732 | 2/1966 | Hansen | 250/83.3 |
| 3,614,450 | 10/1971 | Hill | 250/210 |
| 3,713,966 | 1/1973 | Lippke | 162/263 |
| 3,847,730 | 11/1974 | Doering | 162/198 |
| 3,851,175 | 11/1974 | Dahlin | 250/339 |
| 4,031,752 | 6/1977 | Sanders | 73/159 |
| 4,047,029 | 9/1977 | Allport | 250/273 |
| 4,066,898 | 1/1978 | Kamp et al. | 250/359 |
| 4,375,921 | 3/1983 | Morander | 356/381 |

FOREIGN PATENT DOCUMENTS 2260408 4/1990 United Kingdom .

*Primary Examiner*—Donald E. Czaja
*Assistant Examiner*—Jose A. Fortuna
*Attorney, Agent, or Firm*—Robert R. Reed; Cort Flint

[57] ABSTRACT

An apparatus and method for monitoring the de-watering performance of a forming section of a papermaking machine is disclosed which includes a laser instrument having a laser displacement meter laterally spaced and supported above an upper run of a paper forming fabric having a paper stock deposited thereon. A head box deposits paper stock consisting of a water/fiber mixture on top of the upper run. An adjustable C-shaped carrier stand has an upper leg that supports the laser instrument above the upper run of the forming fabric. The carrier stand has a lower leg to support a baseline contact device below the upper run of the forming fabric. The laser displacement meter is disposed at a laser reference position above the forming fabric so that a laser beam is reflected off of the paper stock which is deposited on top of the forming fabric. The baseline device is disposed at a baseline reference position below said forming fabric so that a first distance between the laser reference and the baseline reference can be measured. The laser meter generates a signal representing a second distance of the top surface of the paper stock from the laser referencec. A controller receives the signal and processes an output value indicating the thickness of the paper stock, having the first distance and the thickness of the forming fabric, and hence the water content of the paper stock is monitored.

31 Claims, 3 Drawing Sheets

Fig. 2
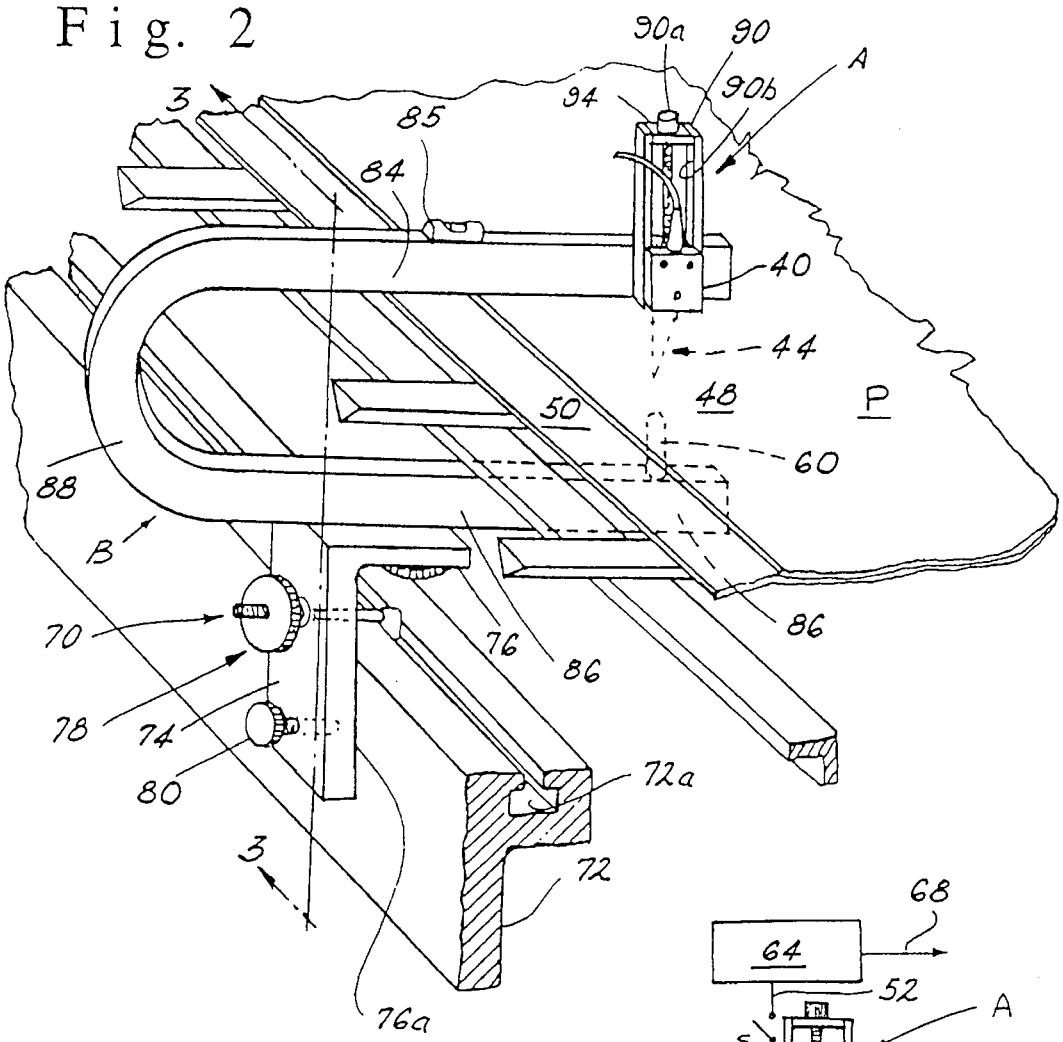
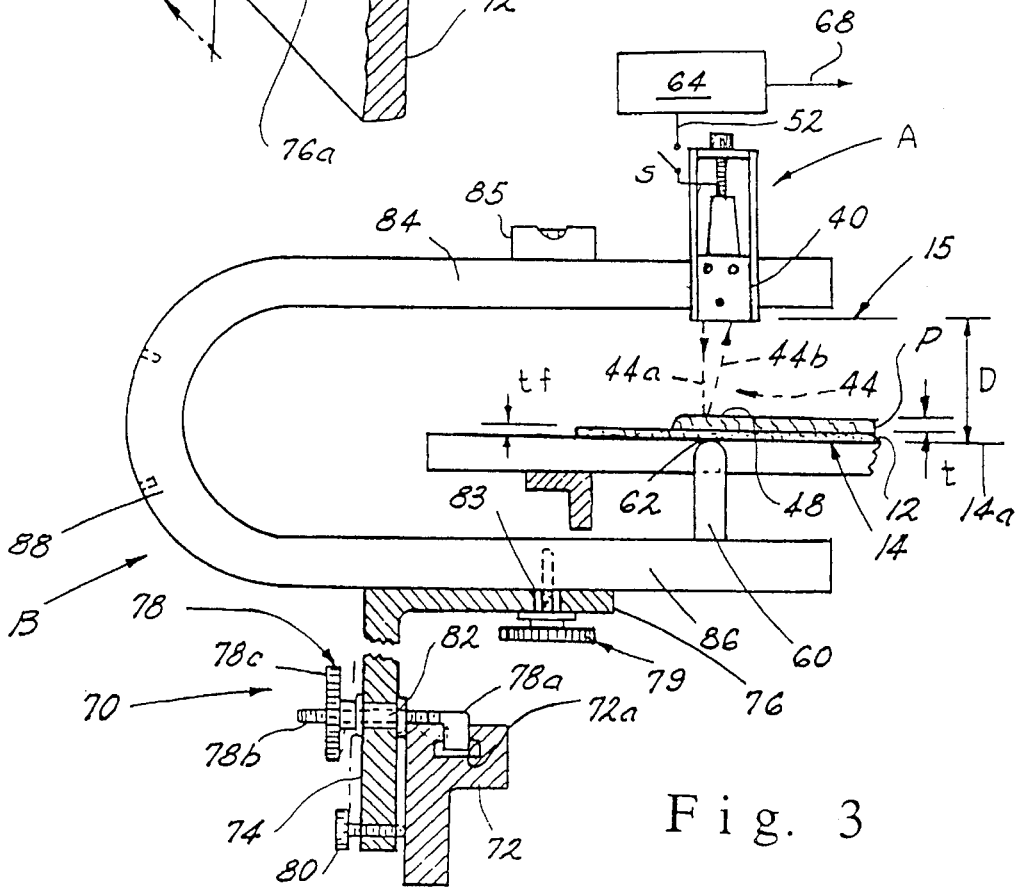
Fig. 3

SIMPLIFIED LASER APPARATUS AND METHOD FOR MEASURING STOCK THICKNESS ON PAPERMAKING MACHINES

This is a continuation-in-part of application Ser. No. 08/282,924 filed on Jul. 29, 1994.

BACKGROUND OF THE INVENTION

The invention is directed to an apparatus and method to measure and paper stock thickness in the forming section of a papermaking machine for monitoring de-watering efficiency.

In the manufacture of paper on papermaking machines, a web of paper is formed from an aqueous suspension of fibers (stock) on a traveling mesh papermaking fabric and water drains by gravity and suction through the fabric. The web is then transferred to the pressing section where more water is removed by pressure and vacuum. The web next enters the dryer section where steam heated dryers and hot air completes the drying process. The paper machine is, in essence, a giant de-watering, i.e, water removal, system. The largest amount of water is taken out in the forming section as the stock is de-watered from a consistency to 0.2%–1½% solids to a web having a consistency of about 18%–25% solids. A typical forming section of a papermaking machine includes an endless traveling papermaking fabric or wire screen which travels over a series of water removal elements such as table rolls, foils, vacuum foils, and suction boxes. The stock is carried on the top surface of the papermaking fabric and is de-watered as the stock travels over the successive de-watering elements to form a sheet of paper. The amount of de-watering is directly proportional to the reduction of the paper stock thickness. Finally, the wet sheet is transferred to the press section of the papermaking machine where enough water is removed to form a sheet of paper with about 36%–44% solids. The various de-watering stations in the forming section have rated capabilities for de-watering. It is advantageous to be able to measure the actual de-watering occurring in the stock to determine if the dewatering element is performing according to its capabilities.

Various devices have been proposed for monitoring the de-watering or drainage efficiency of the papermaking fabric along the forming section. For example, it is know to use an ultrasonic meter to monitor the de-watering efficiency along the forming section. An ultrasonic transistor is placed at different positions under the papermaking fabric and a pulse of ultrasonic energy is reflected from the stock/air interface on top of the fabric. In this manner, information as to thickness of the stock, and hence the degree of de-watering, is obtained. However, since the ultrasonic meter measures the distance to the stock/air interface, there may be variations in the measurements which are not caused by changes in the moisture content. These variations may be due to disturbances in the surface, or due to air entrapment. To over come the deficiencies of the ultrasonic devices, Great Britain Patent No. 2,260,408 discloses a microwave moisture meter for monitoring the de-watering efficiency along the forming section. A microwave moisture meter is placed underneath the fabric, and energy is directed through the fabric and the stock by the meter. Modification of the microwave energy caused by the moisture content of the stock is monitored by the meter. It is said that this arrangement allows the moisture content to be measured substantially without having to make complicated or inconvenient allowances for variations in other parameters.

However, the problem with both the ultrasonic and microwave moisture meters is such meters are operated underneath the papermaking fabric in the forming section of the papermaking machine. This creates difficulty in the ease at which the de-watering measurements may be taken, and can effect the accuracy of the measurements as well.

In addition, it is known to use a device commonly referred to as a Gama- gauge to measure the de-watering efficiency at the various stations in the forming section. However, safety problems due to the radiation associated with these type of devices cannot be entirely ruled out. Also, these devices are relative sensitive which makes their transportation a problem. Other devices for measuring the moisture content of a moving sheet of paper during the manufacturing process of a papermaking machine are disclosed in U.S. Pat. Nos. 3,614,450 and 3,851,175. These devices employ moisture gauges having two detectors of different wavelengths. Typically, one wavelength is highly sensitive to the moisture and the other wavelength is relatively insensitive to the moisture. The ratio of the two signals is utilized to provide a signal representative of the absolute moisture content.

U.S. Pat. No. 3,847,730 discloses a similar system wherein maximum and minimum moisture signals are compared for determining moisture content in the manufacture of paper. U.S. Pat. No. 3,713,966 discloses a plurality of moisture gauges disposed across the width of the moving web which collectively indicate the moisture content of the web.

Accordingly, an important object of the present invention is to provide an apparatus and method for monitoring the de-watering efficiency of a forming section of a papermaking machine which are simple and reliable.

Another object of the present invention is to provide an apparatus and method for monitoring the de-watering efficiency of a forming section of a papermaking machine which does not require electrical devices or meters underneath the papermaking fabric on which the papermaking stock is carried.

Yet another object of the present invention is to provide an apparatus and method for monitoring the de-watering efficiency at various stations along the length of a forming section of a papermaking machine wherein the de-watering monitoring apparatus may be easily transported along the forming section for taking different measurements.

SUMMARY OF THE INVENTION

The above objectives are accomplished according to the invention by providing an apparatus for monitoring the de-watering performance of a forming section of a papermaking machine which includes a laser instrument having a laser displacement meter disposed above the paper stock deposited on an upper run of the forming fabric on the papermaking machine. The apparatus further includes a baseline contact device disposed below the upper run of the forming fabric that establishes a baseline reference for making mesurements. A head box deposits paper stock consisting of a water/fiber mixture on top of the upper run of the forming fabric. A plurality of de-watering mechanisms are disposed in a sequential manner underneath the forming fabric and along the upper run of the fabric for removing water from the stock. The laser instrument has a laser displacement meter that generates a laser beam. A carrier stand having a pair of spaced apart legs including an upper leg portion to mount the laser instrument above the upper run of the forming fabric so that the laser beam is reflected from a top surface of the paper stock. The bottom leg portion of the carrier stand mounts the baseline device directly below said laser instrument and below the upper run of the forming fabric to contact a bottom surface of the upper run of the forming fabric. The displacement meter has a receiver for receiving the reflected beams of the laser meter and generating a signal corresponding to the reflected beam. A controller is provided for receiving the signal and generating an output representing the thickness of the paper stock, and hence the water content of said stock.

The carrier stand can be carried by an adjustable base mount which attaches to the bottom leg portion of the carrier stand and to an associated structure of the machine. The base mount is constructed and arranged to adjust the level condition of the upper leg portion on which the laser instrument is carried. The base mount includes a laterally adjustable support by which the laser instrument and the baseline device may be adjusted in their horizontal positions above and below said paper stock and the upper run of the forming fabric respectively. The base mount further includes a vertical adjustment securing the carrier stand to the associated structure by which the vertical position of the baseline device may be adjusted relative to the bottom surface of the upper run of the forming fabric.

Preferably the carrier stand has a handle attachment, rigidly connected to a vertical leg portion of the carrier stand, to be used by an operator to hold the laser instrument and the baseline device by hand in a known position while the apparatus generates an output to be processed. The handle extends outward of the upper run of the forming fabric for portable movement of the apparatus along the length of the forming fabric to periodically determine the paper stock thickness.

A method for monitoring the de-watering performance of a forming section of a papermaking machine includes providing a baseline reference line at the bottom surface of the upper run of the forming fabric for making measurements therefrom. The method further includes measuring a first vertical distance from the baseline reference to a laser reference line and measuring a second distance from the laser reference to a top surface of the paper stock. An electrical signal is generated corresponding to the second distance and processed along with the first measured distance and the thickness of the forming fabric to generate an output signal representative of a thickness of the paper stock; as an indication of the water content of the paper stock. The method further includes measuring the thickness of the paper stock at a plurality of laser reference positions longitudinally along a length of the upper run of the forming fabric at respective de-watering stations.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is an enlarged perspective view of an apparatus according to the invention;

FIG. 3 is a sectional view taken along lines 3—3 of FIG. 2 illustrating an apparatus for monitoring the de-watering efficiency of a forming section of a papermaking machine according to the invention.

DESCRIPTION OF A PREFERRED EMBODIMENT

Figure 1:
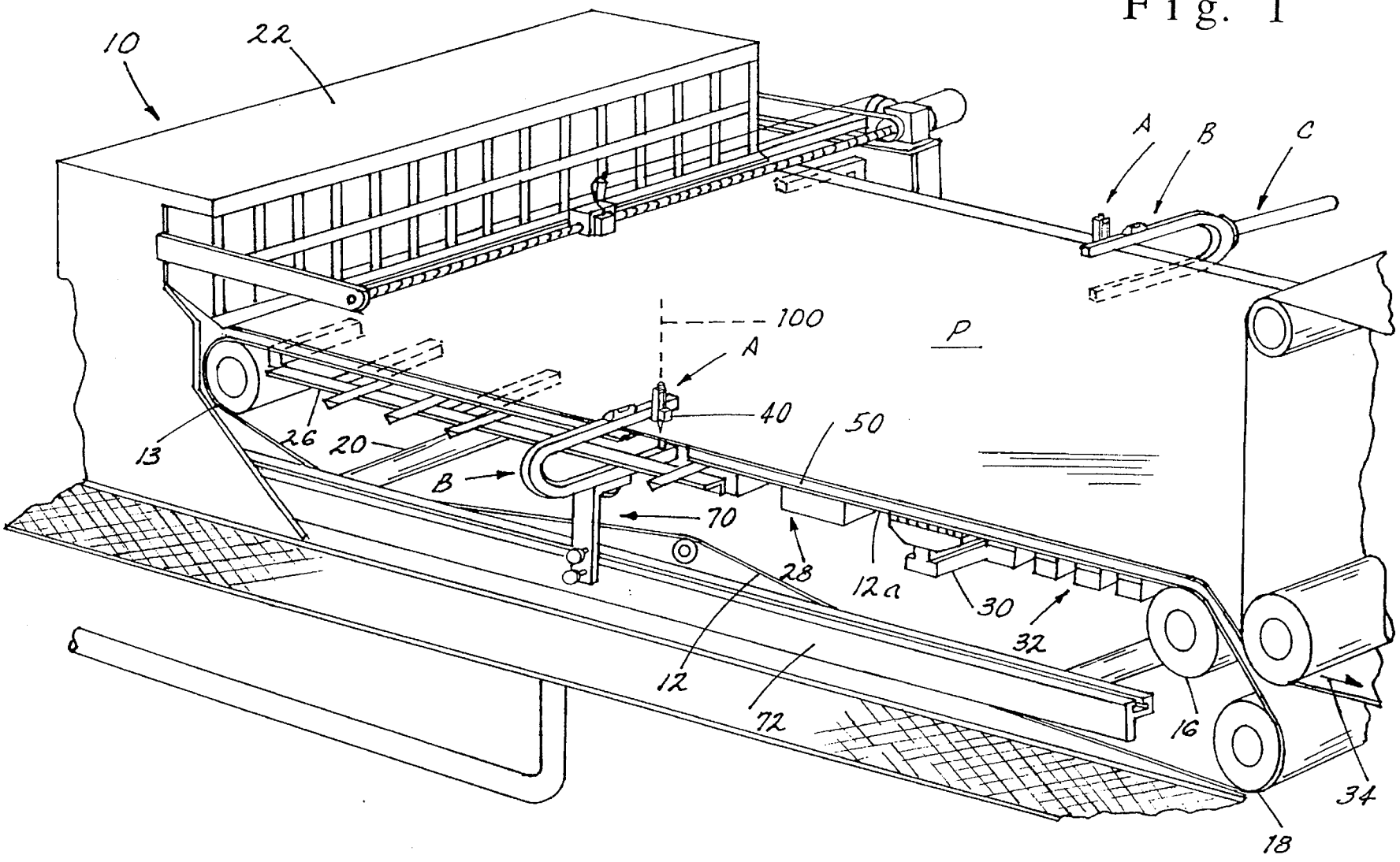
FIG. 1 is a perspective view illustrating an apparatus for measuring the paper stock thickness and thereby monitoring the de-watering efficiency of a forming section of a papermaking machine according to the invention.

Referring now in more detail to the drawings, a formation section of a papermaking machine, designated generally as 10, is illustrated in FIG. 1. Typically, forming section 10 includes a papermaking fabric 12, which is commonly referred to as a fourdrinier or forming fabric or wire screen. Usually, the fabric or wire is formed from metal or plastic wires, e.g. plastic monofilaments. The mesh allows drainage from a paper stock P supported on the fabric. The papermaking fabric travels about a breast roll 13, couch roll 16, drive roll 18, and a plurality of directional rolls 20. A head box 22 receives pulp fiber and water, mixes the water and fiber and deposits the water/fiber mixture onto the papermaking fabric in a form commonly referred to as paper stock, which is designated generally as P.

As can best be seen in FIG. 1, the paper forming section has a plurality of de-watering devices disposed at sequential de-watering stations. For example, the de-watering devices may include a forming board 26, and a plurality of foil boxes 28. Following the foil boxes, there is a vacuum foil 30 and a plurality of suction boxes 32. Finally, there is suction couch roll 16 and the paper stock P is transferred from the forming section to the press section intermediate the couch roll 16 and the directional roll 18 as shown by arrow 34. Forming board 26 supports the fabric between breast roll 13 and first foil box and can be adjusted to provide a desired amount of drainage and de-watering. Gravity removes the water which falls through the open mesh of the papermaking fabric into water trays disposed below the forming section so that the water may be recirculated. Foil boxes 28 remove water by hydrodynamic suction while also supporting the papermaking fabric. The foils can be placed closer together or further apart to adjust the drainage per unit area of the papermaking fabric supported on the foils. Suction boxes 32 remove water at progressively higher vacuum levels toward the couch roll 16. Couch roll 16 is driven to drive both the papermaking fabric and the rest of the rolls, and may be grooved. If a suction couch roll is used, there is a hollow shell with drilled holes and the roll is operated at relative high internal vacuum.

It will be understood that the foregoing de-watering mechanisms and forming sections are conventional. Accordingly, the aforementioned description contains only those features as is necessary to the understanding of the invention.

Referring again to FIG. 1, an apparatus and method for measuring paper stock thickness and thereby monitoring the de-watering performance of the forming section at various stations is illustrated. While monitoring of the de-watering may take place at any number of positions, de-watering is illustrated at station 4 in the illustrated embodiment. Station 1 is at forming board 26. Positions 2–5 for monitoring de-watering efficiency are at foil boxes. De-watering monitoring position 6 is at vacuum foil 30. De-watering monitoring position 7 is at the last suction box before the stock reaches the couch roll 16 and is removed from the forming section and delivered to the press section, as illustrated by arrow 34.

As can best be seen in FIGS. 2 and 3, an apparatus and method for measuring the de-watering performance of a forming section of a papermaking machine is illustrated which includes a laser instrument, designated generally as A, which is supported above an upper run 12*a* of forming fabric 12 by means of a C-shaped carrier stand, designated generally as B. The thickness tf of the upper run 12*a* is known for the type of forming fabric used. Laser instrument A includes a laser displacement meter 40. As illustrated, laser instrument A includes a laser beam 44. As can best be seen in FIG. 3, laser displacement meter 40 emits laser beam 44 which includes a beam 44*a* which impinges upon a top surface 48 of paper stock P, and a reflected beam 44*b* which is reflected back and received by laser displacement meter 40.

A baseline contact device 60 has an upper end 62 that establishes a baseline reference 14*a* for the bottom surface 14 of the upper run 12*a*. A laser reference 15 is established at a parallel position above the baseline reference 14*a* at the laser beam emitter and receiver position on the displacement meter 40. A first distance D is measured vertically between the laser reference 15 and the baseline reference 14*a*.

A signal 52 is generated by the laser displacement meter 40 in response to reflected laser beam 44*b*. Signal 52 is transmitted through a switch S to a host controller 64 representing the distance to the top surface 48 of paper stock P. Host controller 64 processes signal 52, the measured first distance D and the thickness tf of the forming fabric 12*a* and determines a differential signal representing the thickness "t" of paper stock P. This thickness, of course, will vary according to the moisture or water content of the paper stock at the reference station at which the measurement is being made. By measuring the thickness of the paper stock between different de-watering stations, an indication of the de-watering performance of each forming section can be monitored.

Carrier stand B is illustrated as including an adjustable base mount 70 for mounting the carrier stand B to an associated structure 72, which may be a side frame of the forming section as illustrated in FIG. 2. In the illustrated embodiment, carrier stand B includes a horizontal upper leg portion 84 for receiving the laser instrument A. Carrier stand B is supported by an adjustable base mount 70. Adjustable attachments 78 and 80 are provided for affixing vertical leg 74 to associated structure 72. In some machines, forming sections include side frames 72 with a slot 72*a*. In this particular embodiment, the adjustable attachment 78 preferably includes an L-shaped bolt 78*a* having a threaded end 78*b*. A vertical slot 82 in upstanding leg 74 allows for a vertical adjustment of the carrier stand B, as can best be seen in FIG. 3. Threaded end 78*b* slides and rotates relative to this slot 82. An adjustable turn knob 78*c* is threaded onto threaded end 78*b*. Threaded turn screw 80 extends thru upstanding leg 74 as can also best be seen in FIG. 3. The upper leg portion 84 is part of the carrier stand B having a lower leg portion 86 which is affixed to a horizontal leg 76 of the base mount 70 (FIGS. 2 & 3). By tightening turn screw 78*c* and adjusting turn knob 80, the level condition of the upper support leg 84 may be adjusted so that displacement meter 40 is in a level laser reference measuring position. For this purpose, a spirit level 85 may be affixed to upper leg portion 84. A horizontal slot 83 may be provided in leg 76 to accommodate adjusting attachment 79 to provide a horizontal adjustment of the carried stand B, if needed.

Displacement meter 40 is carried by upper leg portion 84 so that reliable positioning over the fabric and paper stock or sheet can be achieved. The displacement meter 40 is carried by a vertical adjustment bracket or mechanism 90 having a micrometer-type turn screw 90*a* providing fine adjustment. Screw 90*a* is threadably journaled in top block 94. Displacement meter 40 is attached to turn screw 90*a* by any suitable manner so that the turn screw moves the meter up and down in precision movements. The displacement meter 40 is constrained and guided by slide ways 90*b*. Also, there is some lateral adjustment for the carrier stand B so that displacement meter 40 may be adjusted laterally with respect to fabric 12 and paper stock or sheet P. The vertical fine adjustments of displacement meter 40 assures the laser reference 15 is positioned to give reliable measurements of the thickness "t" and hence the water content of paper stock P at the various stations along the paper stock.

A thickness measurement may be taken at one station, and then the carrier stand B may be moved to a different de-watering station for measuring and monitoring the de-watering efficiency at that different station. Any suitable displacement meters may be utilized. One suitable displacement meter is a laser displacement meter manufactured by the Keyence Corporation of Osaka, Japan under the model designation KEYENCE LC-2320, and is available from the Keyence Corporation of America, Fair Lawn, N.J. Controller 64 may be any suitable programmed logic controller (PLC). The controller may be suitably programmed to perform an analysis on the laser beam signal, and provide a thickness "t" signal; being the first measured distance D less the sum of the second distance given by the laser beam signal 44*a* and the known forming fabric thickness tf. The output 68 from host controller 64, may be any suitable RS-232 output which may be delivered to an external computer. Alternately, the output may be displayed by the host controller 64 on an associated display panel.

In another embodiment of the invention, a series of laser instruments are mounted generally in a straight line down the length of the wet end section of the papermaking machine in the longitudinal machine direction. Second displacement signals are delivered to a suitable electronic control 100 (FIG. 1) which monitors, and automatically controls the de-watering performance of the de-watering devices at the wet end. This may be accomplished by automatically adjusting the angle of the foil blades, expanding the nip of the foils 28 and/or adjusting and controlling the vacuum in suction boxes 30, 32. In this manner, the performances of the various de-watering mechanisms along the length of the forming section can automatically be monitored and an adjustment be made to assure that the desired de-watering performance is achieved automatically during the process.

Figure 4:
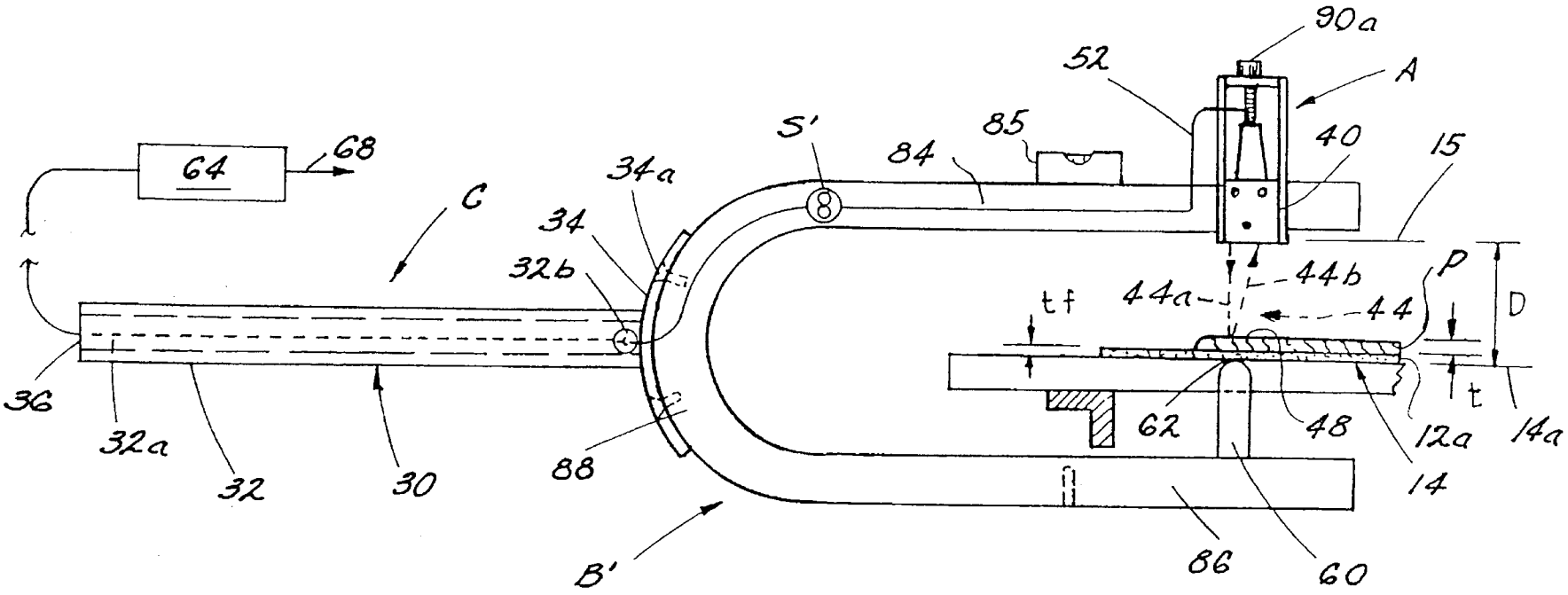
FIG. 4 is a side elevational view of the hand held embodiment of the apparatus in a position for measuring the paper stock thickness and thereby monitoring the de-watering efficiency of the forming section of a papermaking machine according to the invention.

In a preferred embodiment of the invention, as can best be seen in FIG. 4, a laser instrument A may be disposed on a portable carrier stand B' which has a handle attachment C. The handle 30 has a tubular portion 32 which is attached to a bracket 34 having screws 34*a* that fix the handle 30 to the vertical leg portion 88 of the carrier stand B'. Any appropriate method to fix the handle at any selected angular orientation with respect to the carrier stand is within the scope of this invention. The operator of the apparatus holds the handle and positions the baseline contact device 60 in contact with the bottom surface 14 of the top run 12*a* of the forming fabric 12. A baseline device 60 makes contact with the bottom surface 14 at a top point 62. This point 62 establishes a baseline reference line 14*a* at the bottom surface 14. The handle 30 is held in a position such that the upper leg portion 84 of the carrier stand B' is positioned horizontally according to the level sensor 85. The upper leg portion 84 being horizontal establishes a horizontal laser reference line 15 for the displacement meter 40. The fine vertical adjustment screw 90*a* can be adjusted and a first distance D between the laser reference 15 and the baseline reference 14*a* is measured. Any conventional distance measuring device can be used to determine the first distance D, and the carrier stand does not need to be in its operating position for the first distance D to be accurately determined. The same method is used to obtain the paper stock thickness t as was disclosed with the fixed apparatus of FIG. 3.

In a preferred embodiment of this hand held apparatus the cable containing the electrical signals 52, to be processed by the controller 64, are attached to the carrier stand B' and go into the hollow portion 32*a* of the tubular portion 32 of the handle 30 and exit the free end 36 of the handle. This provides for freedom of use in making the apparatus useful for portable operation at various stations along the length of the machine, and on both sides of the machine. A switch S' is also preferred to allow movement of the apparatus without continuous signal generation.

While a preferred embodiment of the invention has been described using specific terms, such description is for illustrative purposes only, and it is to be understood that changes and variations may be made without departing from the spirit or scope of the following claims.

What is claimed is:

1. An apparatus for monitoring the de-watering performance of a forming section of a papermaking machine, said forming section including an associated structure having a side frame and an endless paper forming fabric which travels about a plurality of rolls; said paper forming fabric having an upper horizontal run, a head box for depositing paper stock consisting of a water/fiber mixture on top of said upper horizontal run of said forming fabric; a plurality of de-watering mechanisms disposed sequentially underneath said fabric along said upper horizontal run of said fabric for removing water from said stock; wherein said apparatus comprises:

a carrier stand having a pair of spaced apart legs including a top leg and a bottom leg for being positioned above and below said horizontal run of said fabric, respectively;

a laser instrument carried by said top leg portion of said carrier stand and having a laser beam;

a baseline contact device carried by said bottom leg portion of said carrier stand for contacting a bottom surface of said horizontal run of said fabric to establish a baseline reference a first distance directly below said laser instrument;

said carrier stand positioning said laser instrument above said upper horizontal run of said forming fabric so that said laser beam is reflected from a top horizontal surface of said paper stock and said carrier stand supporting said baseline device which contacts said bottom surface of said upper horizontal run of said forming fabric which is devoid of said paper stock;

said laser instrument including a laser displacement meter having a receiver for receiving said reflected laser beam of said laser meter and generating a signal corresponding to said reflected laser beam and distance to said upper run of said fabric; and a controller for receiving said signal and for computing and generating an output representative of a thickness of said paper stock, and hence the relative water content of said stock, based on said signal and said baseline reference.

2. The apparatus of claim 1 wherein said carrier stand is carried by an adjustable base mount which attaches to the bottom leg portion of said carrier stand and to an associated structure of the machine, said base mount being constructed and arranged to adjust the level condition of said upper leg portion on which said laser instrument is carried.

3. The apparatus of claim 2 wherein said base mount includes a laterally adjustable support by which said laser instrument and said baseline device may be adjusted in their horizontal positions above and below said paper stock and said upper run of said forming fabric respectively.

4. The apparatus of claim 2 wherein said base mount comprises a vertical adjustment securing said carrier stand to said associated structure by which a vertical position of said baseline device may be adjusted relative to said bottom surface of said upper run of said forming fabric.

5. The apparatus of claim 1 wherein the apparatus comprises a base mount to provide an adjustment for mounting said carrier stand to said associated structure of said forming section so that a location of said baseline device below said forming fabric may be adjusted.

6. The apparatus of claim 1 wherein said laser displacement meter of said laser instrument is mounted in a laser bracket for receiving back said reflected laser beam.

7. The apparatus of claim 6 wherein said laser bracket includes a fine vertical adjustment mechanism for adjusting the vertical position of said displacement meter above said paper stock.

8. The apparatus of claim 7 wherein said apparatus comprises a base mount having a lateral adjustment mechanism for adjusting the horizontal position of said displacement meter above said paper stock.

9. The apparatus of claim 1, wherein the carrier stand has a handle attachment used by an operator to hold said laser instrument and said baseline device by hand in a known position while said apparatus generates an output representing said thickness of said paper stock.

10. The apparatus of claim 9 wherein said handle attachment is rigidly connected to a vertical leg portion of said carrier stand and extends outward of said upper run of said forming fabric for portable movement of said apparatus longitudinally along the length of said forming fabric to periodically determine said paper stock thickness.

11. An apparatus for monitoring the de-watering performance of a forming section of a papermaking machine, said forming section including an associated structure having a side frame and an endless paper forming fabric which travels about a plurality of rolls; said paper forming fabric having an upper run, a head box for depositing paper stock consisting of a water/fiber mixture on top of said upper run of said forming fabric; a plurality of de-watering mechanisms disposed sequentially underneath said fabric along said upper run of said fabric for removing water from said stock; wherein said apparatus comprises:

a laser displacement meter disposed in a first position above said forming fabric so that a laser beam of said laser meter is reflected off of a top surface of said paper stock deposited on top of said forming fabric and provide a signal representing a distance from said displacement meter to said top surface;

a baseline contact device disposed below said laser displacement meter in a second position below said top run of said forming fabric so that a top edge of said baseline device contacts a bottom surface of said top run of said forming fabric to establish a baseline reference a predetermined distance below said laser displacement meter;

a carrier stand for supporting said displacement meter in said first positions above said upper run of said forming fabric and for supporting said baseline contact device in said second position below said upper run of said forming fabric; and a controller for processing said signal of said laser displacement meter with respect to said baseline reference and provide an output representing a thickness and hence water content of said paper stock.

12. The apparatus of claim 11 wherein said carrier stand comprises an upper leg portion on which said displacement meter is supported above said upper run of said forming fabric in a laterally positioned configuration from said associated structure.

13. The apparatus of claim 12 wherein said carrier stand is supported by an adjustable base mount which may be attached to said associated structure of said papermaking machine so that said carrier stand may be adjusted longitudinally along the length of said forming fabric whereby a plurality of thickness measurements may be taken along said upper run of said forming fabric.

14. The apparatus of claim 13 wherein said base mount comprises a vertical adjustment securing said baseline device to said associated structure for vertical adjustment of said baseline devicer relative to a bottom surface of said upper run of said forming fabric.

15. The apparatus of claim 13 wherein said base mount comprises a vertical adjustment securing said displacement meter to said associated structure for adjusting a vertical position of said displacement meter relative to said paper stock.

16. The apparatus of claim 13 wherein said carrier stand is supported by an adjustable base mount for mounting said carrier stand to said associated structure of said forming section so that the horizontal position of said laser instrument along said forming fabric may be adjusted.

17. The apparatus of claim 16 wherein said adjustable base mount comprises an adjustable attachment to a lower leg of said carrier stand and which attaches to a side frame of said associated structure of said forming section.

18. The apparatus of claim 17 wherein said adjustable attachment fits within a slot formed in said side frame.

19. The apparatus of claim 11 including a controller for receiving signals corresponding to said reflected laser beam, said controller processing signals for generating an output representative of a thickness of said paper stock and hence the water content of said paper stock.

20. The apparatus of claim 11 including a handle attachment used by an operator to position the carrier stand in a location such that said displacement meter and said baseline device generate said laser beam signals to determine said thickness of said paper stock.

21. The apparatus of claim 20, wherein said handle attachment is rigidly connected to a vertical leg portion of said carrier stand and extends outward of said upper run of said forming fabric for portable movement of said apparatus by said operator longitudinally along the length of said upper run of said forming fabric to perodically determine said paper stock thickness.

22. A method of monitoring the de-watering performance of a forming section of a papermaking machine wherein said forming section includes an associated structure having a side frame and an endless paper forming fabric of a known thickness which travels about a plurity of roles; said paper forming fabric having an upper run, a head box for depositing paper stock consisting of a water/fiber mixture on top of said upper run; a plurity of de-watering machanisms disposed sequentially underneath said fabric along said upper run for removing water from said paper stock, wherein said method comprises.

providing a laser instrument attached to a carrier stand for generating an electrical signal;

providing a baseline reference line at the bottom surface of said upper run of said forming fabric for making measurements;

measuring a first vertical distance from said baseline reference to a laser reference line position;

measuring a second distance from said laser reference to a top surface of said paper stock;

generating an electrical signal corresponding to said second distance and processing said signal along with said first distance and said forming fabric thickness to generate an output signal representative of a thickness of said paper stock as an indication of the water content of said paper stock.

23. The method of claim 22 comprising measuring said thickness of said paper stock at a plurality of said laser reference positions longitudinally along a length of said upper run of said forming fabric at respective de-watering stations.

24. The method of claim 22 comprising a baseline contact device attached to a bottom leg of said carrier stand that contacts the bottom surface of said upper run of said forming fabric to establish said baseline reference position.

25. The method of claim 22 comprising measuring said second distance by using a laser displacement meter disposed above said upper run of said forming fabric at each said laser reference position.

26. The method of claim 25 comprising adjustably mounting said laser displacement meter at a lateral position across the width of said forming fabric so that said laser beam impinges upon said top surface of said paper stock directly above said baseline reference and is reflected back to said laser displacement meter.

27. The method of claim 26 comprising supporting said laser displacement meter on a carrier stand which may be moved longitudinally along the length of said forming fabric.

28. The method of claim 27 including mounting said displacement meter on a top horizontal leg of said carrier stand and adjusting the level condition of said top leg at said laser referenced position to assure that said displacement meter is level and is located directly above said paper stock and a top point of said baseline contact device.

29. The method of claim 28 including an operater holding the displacement meter at said laser reference using a handle attachment and a level on said carrier stand such that said electrical signals can give said second distance.

30. The method of claim 27 including an adjustable base mount supporting said carrier stand at a lower horizontal leg of said carrier stand, said base mount can be positioned longitudinally along the length of said associated structure of said machine whereby a plurality of measurements may be taken along said paper stock.

31. The method of claim 30 comprising adjusting the vertical positions of said base mount relative to said associated structure and the horizontal position of said carrier stand relative to said base mount to position a baseline contact device at said baseline reference.

* * * * *